US005601967A

United States Patent [19]

Brust et al.

[11] Patent Number: 5,601,967

[45] Date of Patent: Feb. 11, 1997

[54] BLUE SENSITIZED TABULAR EMULSIONS FOR INVERTED RECORD ORDER FILM

[75] Inventors: Thomas B. Brust; James T. Kofron, both of Rochester, N.Y.

[73] Assignee: Eastman Kodak Company, Rochester, N.Y.

[21] Appl. No.: 656,660

[22] Filed: Feb. 19, 1991

Related U.S. Application Data

[63] Continuation-in-part of Ser. No. 632,686, Dec. 19, 1990, abandoned.

[51] Int. Cl.[6] ..... G03C 1/00; G03C 1/14

[52] U.S. Cl. ..... 430/505; 430/507; 430/567; 430/583

[58] Field of Search ..... 430/567, 503, 430/505, 581, 506, 583, 507

[56] References Cited

U.S. PATENT DOCUMENTS

| | | | |
|---|---|---|---|
| 4,102,688 | 7/1978 | Sugiyama et al. . | |
| 4,439,520 | 3/1984 | Kofron et al. . | |
| 4,490,458 | 12/1984 | House . | |
| 4,582,786 | 4/1986 | Ikeda et al. . | |
| 4,663,271 | 5/1987 | Nozawa et al. . | |
| 4,672,027 | 6/1987 | Daubendiek et al. . | |
| 4,724,201 | 2/1988 | Okazaki et al. . | |
| 4,740,454 | 4/1988 | Deguchi et al. . | |
| 4,748,106 | 5/1988 | Hayashi . | |
| 4,888,272 | 12/1989 | Kishida et al. | 430/567 |
| 4,906,555 | 3/1990 | Hiron et al. | 430/505 |

FOREIGN PATENT DOCUMENTS

| | | |
|---|---|---|
| 0219849 | 4/1987 | European Pat. Off. . |
| 696474 | 9/1953 | United Kingdom . |

*Primary Examiner*—Thorl Chea
*Attorney, Agent, or Firm*—Paul A. Leipold

[57] ABSTRACT

The invention is generally accomplished by providing an inverted order film in which the lowermost light sensitive layer is a blue-sensitive layer of blue-sensitized tabular grains. The blue-sensitized tabular grains are preferably sensitized to a wavelength of between 450 and 520 nm. The blue-sensitive layer is preferably sensitized in the blue region that has the maximum blue light transmission through the green and red sensitized layers overlaying the blue sensitized layer,

8 Claims, 2 Drawing Sheets

BLUE SENSITIZED TABULAR EMULSIONS FOR INVERTED RECORD ORDER FILM

CROSS REFERENCE TO RELATED APPLICATION

This is a continuation-in-part of our earlier filed application Ser. No. 632,686 filed on Dec. 24, 1990.

FIELD OF THE INVENTION

The invention relates to color photographic light sensitive materials and more particularly relates to color photographic films in which the blue-sensitive emulsion is overlayed by at least the green-sensitive emulsion.

BACKGROUND ART

Formation of a color photographic image requires recording the blue, green, and red content of the scene in spectrally sensitized emulsions. The three sensitive emulsions are most commonly coated in a multilayer arrangement. All silver halide emulsions have natural sensitivity to blue and ultraviolet radiation. Emulsions intended for the magenta layer(s) are dyed with a green-light-absorbing sensitizing dye and have green sensitivity in addition to the natural blue sensitivity; those intended for the cyan layer(s) are dyed with a red light absorbing sensitizing dye and have red sensitivity in addition to the natural blue sensitivity. The usual layer order of a multilayer color film places the blue-sensitive (yellow dye forming) layer(s) on the top where they are the first of the sensitive layers to be exposed by the incident light. A yellow filter layer is usually coated below the blue sensitive layer to absorb any residual blue light and to prevent the green-sensitive (magenta dye forming) and red sensitive (cyan dye forming) layers, coated beneath, from being exposed by blue light. Such exposure of the green-sensitive and red-sensitive layers by blue light is undesirable because it would result in degradation of colors. There is a disadvantage to this layer arrangement commonly used in multilayer color films, because of the scatter of light by silver halide grains. The green and red light must pass through the blue-sensitive emulsion layer and the yellow filter layer before it can expose the green- and red-sensitive emulsion layers. The scattering of the green and red light by the silver halide and the material making up the yellow filter layer results in a degradation or distortion of the images formed in the green- and red-sensitive emulsions layers. Since the human eye is most sensitive to green light, the degradation of the image in the green-sensitive layer is of greatest consequence. Among the potential solutions to this problem would be to coat the green-sensitive layer in the uppermost position where the incident light entering the film would strike it first.

Multilayer color films with the green-sensitive emulsion layer and the red-sensitive emulsion layer coated above the blue-sensitive layer—so-called "inverted structure" films—are known in the art. Such films have not been fully satisfactory, however, as to speed and image structure. This is because in the inverted order films the blue-sensitive layer, being on the bottom of the film, was required to be of very high speed because much of the blue light entering the film was absorbed by masking couplers for camera speed materials and absorbed and scattered by the green-sensitive and red-sensitive emulsion layers before reaching the blue sensitive emulsion layer. This problem is alleviated by using emulsions in the green-sensitive and red-sensitive layers which are high in chloride and have minimal absorption in the blue region of the electromagnetic spectrum. Such emulsions, however, are less suitable for attaining speeds adequate for camera speed application and their use has been restricted to materials intended for producing prints from color negatives (e.g. Eastman Color Print Film).

Another problem in such inverted structure films is the minus blue/blue exposure separation which is assessed by measuring the difference between the speed of the blue sensitive layer and the speed of the green-sensitive or the red-sensitive layer when the film is exposed to blue light. In films possessing the usual layer order, the speed to a blue light exposure of the green-sensitive and red-sensitive layers is at least 1.0 log exposure units less than the speed of the blue-sensitive layer. This lower speed is primarily due to the absorption of blue light by the masking couplers, blue-sensitive layer, and a blue light filter such as a yellow dye or yellow colloidal silver. In the inverted structure films, blue light reaches the green-sensitive and/or red-sensitive layers without being attenuated by such blue-sensitive and yellow filter layers. This results in more exposure by blue light and less minus blue/blue exposure separation for the green- and red-sensitive layers.

U.S. Pat. Nos. 4,439,520 and 4,672,027 disclose the use of tabular grain emulsions of high aspect ratio to improve the minus blue/blue exposure separation when used in multicolor photographic elements and recommends their use in the green-sensitive and red-sensitive layers of films in which these layers are coated above the blue-sensitive layer. This provides an improvement in the art but the loss in blue light to absorption and scatter by the overlying imaging layers requires the use of the highest speed blue-sensitive emulsions in the underlying blue sensitive layer and such emulsions have a high level of graininess and limit the maximum speed attainable by the multilayer color film.

Thus, although it is possible to produce multilayer color films in which the green-sensitive and red-sensitive layers are coated above the blue sensitive layer, and these films have the superior sharpness associated with the elimination of scatter of the green light and minimizing that of the red light, there is a limitation in the maximum speed attainable because such films have a high level of yellow graininess and the minus-blue/blue exposure is barely acceptable. Further improvements in inverted structure films to take advantage of the enhanced sharpness but with improved yellow layer graininess, better minus-blue/blue exposure separation and at higher speed are highly desirable. Better minus-blue/blue exposure means that there is a greater difference in the speed of a green-sensitive or red-sensitive layer when exposed to light not containing blue light than when exposed to blue light than a comparative film emulsion.

DISCLOSURE OF THE INVENTION

The object of the invention is to provide multilayer color photographic elements of an inverted structure, with the green-sensitive and red-sensitive layers overlying the blue-sensitive layer, which are of higher speed than those previously obtainable.

A further object is to provide such inverted structure multilayer color photographic elements which have improved exposure separation.

Another objective is to provide such multilayer color photographic elements of an inverted structure which have improved graininess in the blue sensitive layer.

These and other objects of the invention are generally accomplished by providing an emulsion for the blue-sensitive layer, which lies below the green-sensitive and red-sensitive layers, which consists of a high aspect ratio tabular emulsion with an aspect ratio of at least 5 and preferably greater than 8. This tabular emulsion is sensitized with a blue sensitizing dye which absorbs primarily in the region between 450 and 520 nanometers, in a region where the overlying green-sensitive and red-sensitive layers absorb the least amount of blue light. The invention also provides for the use of blue light filters such as dyes, masking couplers, or yellow colored colloidal silver above or within the green and/or red sensitized emulsion layers which absorb primarily in the region between 400 and 450 nanometers, thereby increasing the exposure separation of the green-sensitized and red-sensitized layers but having minimal effects on the speed of the blue-sensitive layer. The filter layer absorbs in the natural sensitivity range of the silver halide used in the blue, green, and red sensitized emulsion layer. The lower layer tabular grains are blue sensitized in the region of 450–520 nanometers and therefore are less affected.

MODES OF PERFORMING THE INVENTION

The invention has numerous advantages over other inverted record order films. The films of the invention provide a speed/grain advantage over prior inverted record order systems. The invention films have improved sharpness as the green light is imaged with less distortion than prior films. Another advantage of the invention is that the materials utilized in the color films of the invention are generally similar to those utilized in prior films so that exotic formation techniques are not required. These and other advantages of the invention will be apparent from the description given below.

As above discussed, when the blue-sensitive layer is located below the green-sensitive layer the loss of speed in the blue light-sensitive layer by inherent blue light absorption of the overlaying green-sensitive layer detracts from the performance of such films. As used herein the term "below" as applied to a film means farther from the side of the film where exposure takes place and closer to the film base or substrate. The term "above" means farther from the film base and closer to the side where exposure takes place. It has now been found that by careful sensitization of tabular grains in the blue-sensitive layer to be sensitive to certain wavelengths not significantly absorbed by the overlaying magenta layer, that improved films may result. Generally, the magenta layer will absorb primarily in the green-sensitive region, but also in certain portions of the blue-sensitive region of the visible spectrum. By sensitization of the underlaying blue-sensitive layer primarily in those regions not absorbed by the overlaying magenta layer, excellent photographic performance may be obtained with minimum speed loss. Thus, in the invention, the blue layer is designed to absorb to a high degree and very efficiently in the exact region that is not absorbed significantly by the overlaying magenta layer. It is also likely that a cyan (red-sensitive) layer will also overlay the blue-sensitive layer and also absorb blue light as a red-sensitive layer is necessary for a full color product. The order of the red-sensitive and green-sensitive layers above the blue-sensitive layer is preferred to be green-sensitive on top with red-sensitive in the middle because the eye is most sensitive to green light. However, the red-sensitive layer may be the top layer of the film.

Figure 1:
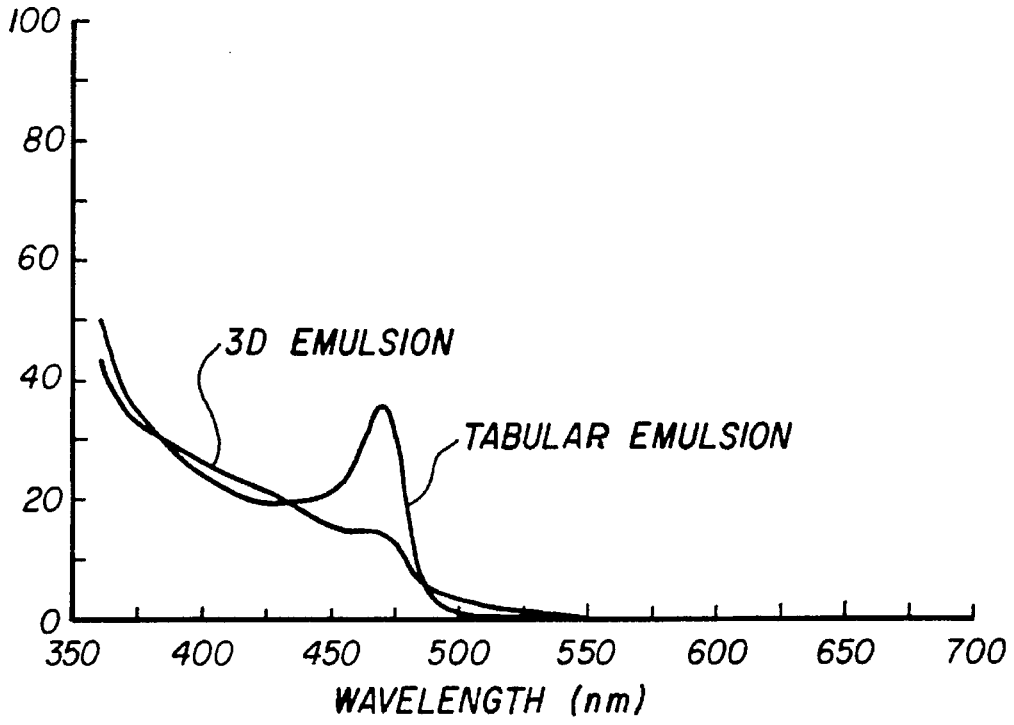
FIG. 1 illustrates the comparison of the absorption wavelengths for a tabular emulsion dyed with the blue sensitizing dye and a 3D emulsion also dyed with the dye.

Shown in FIG. 1 is a comparison of the wavelength absorption of a tabular emulsion dyed with a particular blue-sensitizing dye A, identified below and a 3D emulsion dyed with the identical dye. As can be seen, the tabular grain emulsion has a great deal of absorption in the 450 to 470 nm wavelength region. In contrast, the 3D emulsion has a generally tapering wavelength absorption with only a slight rise in the 470 nm region. The reason for this difference is that the tabular emulsion provides significantly more surface area for adsorption of the sensitizing dye. In the illustration of FIG. 1, the emulsions are each sensitized to about 70 to 80 percent of surface saturation. However, the tabular emulsion has about 20 times the surface area. Therefore, the sensitizing dye causes a great difference in sensitivity of the tabular silver halide grain to the wavelength at about 470 nm.

Figure 2:
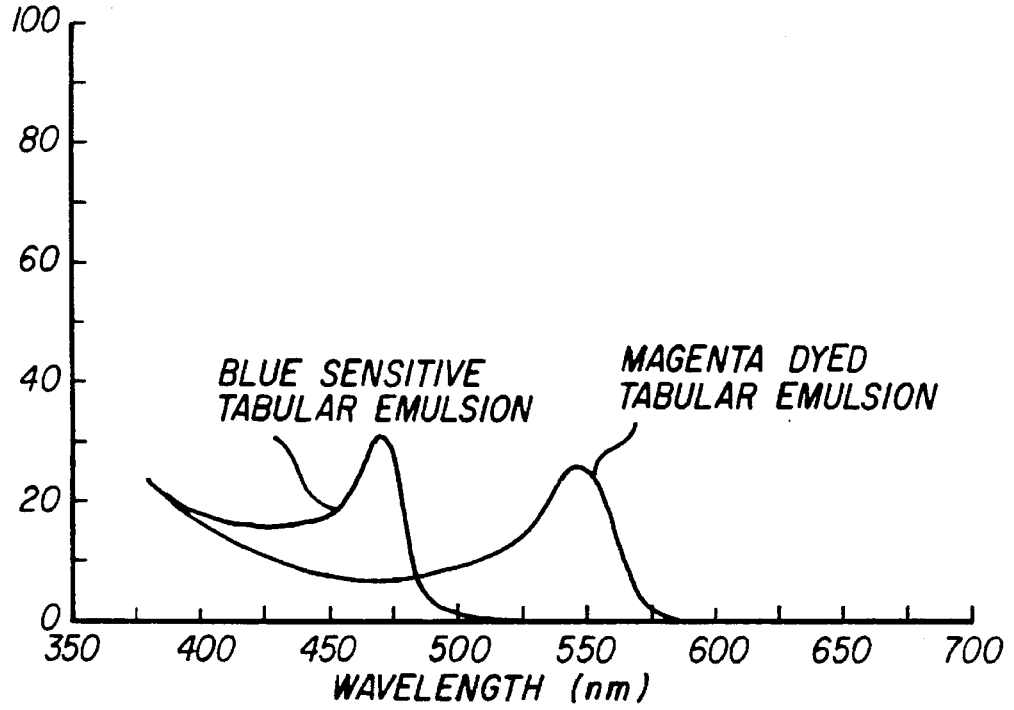
FIG. 2 illustrates the wavelength sensitivity of a magenta-dyed green light absorbing emulsion and a blue sensitized tabular emulsion.

In FIG. 2 is illustrated the comparison of the wavelength sensitivity of a magenta-dyed, green sensitive tabular emulsion and the tabular blue-sensitized emulsion of FIG. 1. The comparison shows that the magenta-dyed, green sensitive tabular emulsion has a great deal of absorption in the regions surrounding the 540 nm range and then a decline in absorption in the 470 nm range with an increasing absorption at around 400 nm in the natural absorption range of silver halide. The blue-sensitized tabular emulsion of the invention, being sensitive to light in the wavelength surrounding the 470 nm wavelength, has a great deal of absorption in the area where the magenta-dyed, green sensitive emulsion will pass the light.

Figure 3:
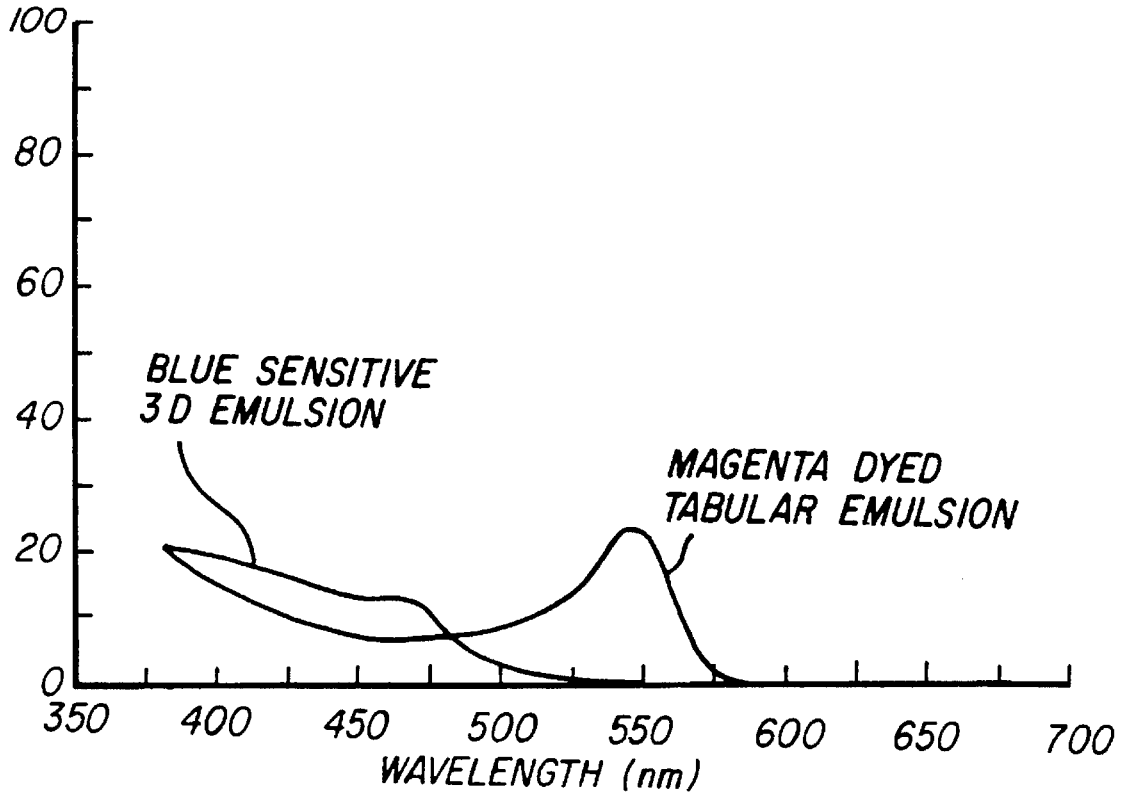
FIG. 3 illustrates the wavelength sensitivity of a blue sensitized 3D emulsion and a magenta-dyed green light absorbing tabular emulsion.

FIG. 3 is a comparison of the same magenta-dyed, green sensitive tabular emulsion in combination with the blue-sensitized 3D emulsion. As is apparent, the blue-sensitized 3D emulsion tends to absorb blue light in the same wavelength region as the inherent absorption of the silver halide which is green sensitized with the magenta dye. Therefore, the speed of the blue-sensitive 3D tabular emulsion would be required to be very high in order to adequately image the remaining wavelengths after passing through the magenta-dyed green sensitive layer. The overlaying green sensitive magenta emulsion causes large blue speed losses in the underlying blue-sensitive emulsion by screening these wavelengths from the emulsion. In contrast, it is illustrated in FIG. 2 that the screening absorption of blue light by the magenta emulsion is minimized as the tabular blue-sensitive emulsion is primarily sensitive in the wavelength where the magenta-dyed green sensitive emulsion is most transparent.

The blue-sensitive tabular emulsion may be sensitized in any range that is least absorbed by the overlaying magenta (green-sensitized emulsion). However, typically the desired range of sensitization will be between about 450 and 520 nm as this is typically the low absorption point of the magenta dyed emulsions absorption, as well as being satisfactorily in the blue wavelength region.

The films of the invention may use a magenta dye forming yellow colored coupler. The coupler would be placed in the magenta (green absorbing) layer above the blue sensitive layer and serve as a filter layer for short blue (400–450 nm) light.

The tabular and 3D emulsions may be formed by any of the known processes in the art. Typical of such processes are those disclosed in U.S. Pat. No. 4,439,520—Kofron et al and in *Research Disclosure* No. 17643 (December, 1978), page 22 and 23 I Emulsion Preparation and Types and *Research Disclosure* No. 18716 (November, 1979) page 648. The techniques of sensitization by dye addition are well-known and illustrated in Research Disclosures as cited above. The photographic emulsions for use in the invention may be spectrally sensitized by adding methine dyes or the like to the emulsion before completion of formation of the grains. Dyes for use in the invention include cyanine dyes, merocyanine dyes, composite cyanine dyes, composite merocyanine dyes, homopolar cyanine dyes, hemicyanine dyes, styryl dyes and hemioxonole dyes.

The invention is suitable for both color positive and color negative films. The conventional couplers and other addenda as set forth in the above cited Research Disclosure 17643 may be utilized in films of the invention.

The tabular emulsion utilized in the blue-sensitized layer of the invention may be formed by any of the known tabular emulsion forming techniques such as those illustrated in U.S. Pat. No. 4,433,048—Solberg et al and U.S. Pat. No. 4,439,520—Kofron et al, both hereby incorporated by reference. The aspect ratio, which has been defined as the ratio of equivalent circular diameter to thickness may be any amount that gives a desired result with a particular film. Generally, it is desired that the aspect ratio be at least 8 in order to insure adequate blue sensitivity by providing a high degree of surface area for dye adsorption. The aspect ratio specified should be present in at least 70% and preferably 90% of the grains of the emulsion. The surface to volume ratio is preferrably at least about 10 $\mu m^{-1}$.

EXAMPLES

The following examples are intended to be illustrative and not exhaustive of the possibilities of the invention. Parts are by weight unless otherwise otherwise indicated.

Example 1

(Control)

The following two-color film is formed on a base of cellulose triacetate.

Layer 1

Blue Light-Sensitive Layer—comprising a polydisperse non-tabular bromoiodide emulsion approximately 2.3 μm in mean diameter with a bulk iodide content of 9 mole percent, chemically and spectrally sensitized with sodium thiosulfate, potassium chloroaurate, sodium thiocyanate, and blue sensitizing dye A covering approximately 80% of the available grain surface area by methods well known in the art, and coated at 2.15 g/m$^2$, cyan image-forming coupler A at 1.08 g/m$^2$, gelatin at 2.15 g/m$^2$ and antifoggant 4-hydroxy-6-methyl-1,3,3a,7-tetraazaindene at 0.05 g/m$^2$, and bis(vinylsulfonylmethyl)ether at 1.75% of total gelatin weight.

Layer 2

Interlayer—comprising gelatin at 1.61 g/m$^2$, and bis(vinyl-sulfonylmethyl)ether at 1.75% of total gelatin weight.

Layer 3

Green light-sensitive layer—comprising a polydisperse bromoiodide tabular emulsion approximately 2.5 μm in diameter and 0.13 μm thick with a bulk iodide content of 6%, chemically and spectrally sensitized with sodium thiosulfate, potassium chloroaurate, sodium thiocyanate, and green spectral-sensitizing dyes B and C using methods well known in the art, and coated at 0.54 g/m$^2$, magenta image dye-forming coupler B at 1.08 g/m$^2$, gelatin at 2.15 g/m$^2$.

Layer 4

Overcoat—comprising gelatin at 2.15 g/m$^2$.

Example 2

(Control)

A four-layer structure identical to Example 1 except that the tabular emulsion in layer 3 is coated at 1.08 g/m$^2$.

Example 3

(Control)

A four-layer structure identical to Example 1 except that the tabular emulsion in layer 3 is coated at 2.15 g/m$^2$.

Example 4

A four-layer structure identical to Example 1 except that the non-tabular blue-sensitive emulsion in layer 1 is replaced by a 9% bulk iodide bromoiodide tabular emulsion of approximately 5 μm in diameter and 0.10 μm in thickness also spectrally sensitized with blue-sensitizing dye A covering approximately 80% of the available surface area, coated at 1.35 g/m$^2$ along with an insensitive Lippmann-type silver chloride cube coated at 0.22 g/m$^2$.

Example 5

A four-layer structure identical to Example 4 except that the green sensitive tabular emulsion in layer 3 is coated at 1.08 g/m$^2$.

Example 6

A four-layer structure identical to Example 4 except that the green-sensitive tabular emulsion in layer 3 is coated at 2.15 g/m$^2$.

Example 7

(Control)

A two-layer structure composed of layers 1 and 2 of Example 1.

Example 8

(Control)

A two-layer structure composed of layers 1 and 2 of Example 4.

Although layer 1 contains a blue light-sensitized emulsion, a cyan image dye-forming coupler was used in this model experiment solely on the basis of convenience. In an inverted record order film element which would be used for conventional photographic purposes rather than simply optical measurements, a yellow image dye-forming coupler would be used in the blue-light sensitive layer as is standard in color negative film construction.

Spectral-sensitizing dyes used in the photographic elements described above have the following structures:

Blue light-sensitizing dye A

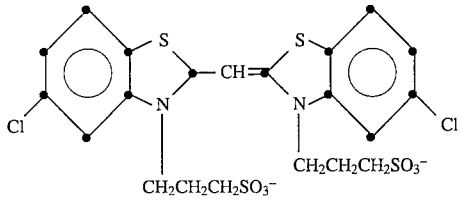

-continued

Green light-sensitizing dye B

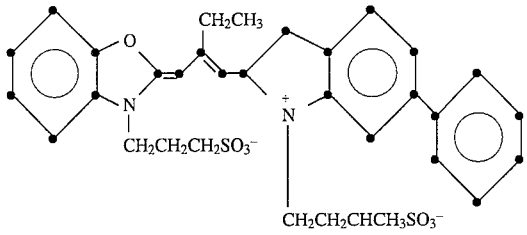

Green light-sensitizing dye C

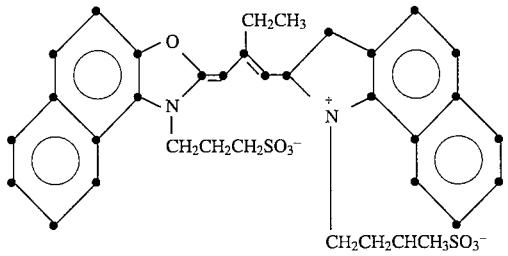

Image dye-forming coupler used in the photographic elements described above have the following structures:

Cyan dye-forming coupler A

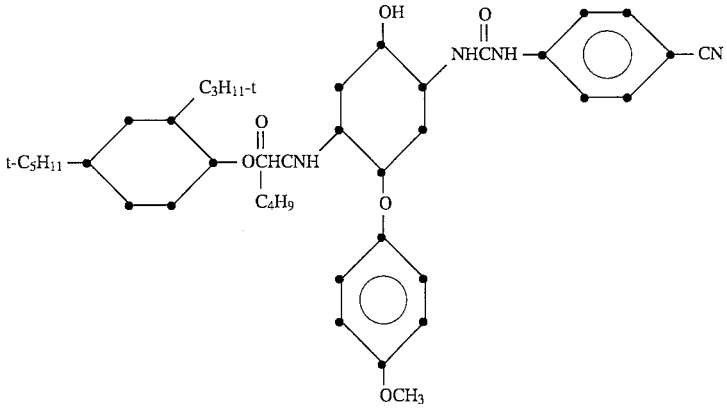

Magenta dye-forming coupler B

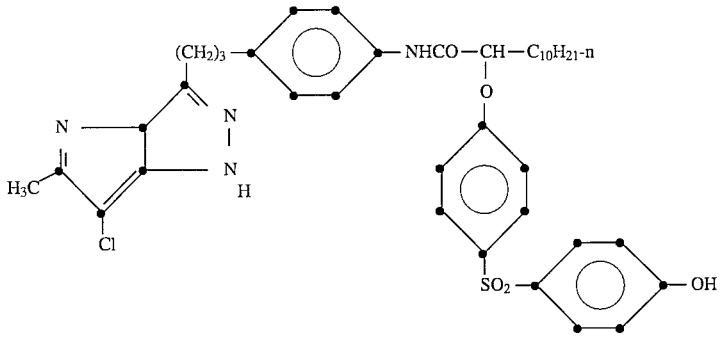

Examples 1–8 were exposed for 0.01 second with a 2850K light produced by a 600 watt tungsten source that was filtered by a daylight V filter to approximate a 5500K source. This light was attenuated by an inconel filter of density 1.3 then passed through a 0–3 by 0.15 neutral density step tablet.

To allow a special type of processing which isolates optical effects from chemical effects, only layers 1 and 2 of each Example film were hardened. This allowed the coatings to be exposed as the full four-layer element, but processed as only the bottom two layers by washing off the top two layers so that chemical interactions between that green-sensitized emulsion and the blue-sensitive emulsion, which could interfere with the results, are eliminated. Five different coatings of each element were processed for 1.5, 2.25, 3.25, 4.5, and 6 minutes of development, in a seven-step process which proceeds as follows:

Step 1

The coatings are immersed for 10 minutes in a 38° C. water bath to remove the unhardened emulsion and gelatin layers.

Step 2

The coatings are then developed for the specified time at 38.0° C. in a solution comprising:

| | |
|---|---|
| Potassium carbonate, anhydrous | 34.30 g |
| Potassium bicarbonate | 2.32 g |
| Sodium sulfite, anhydrous | 0.38 g |
| Sodium metabisulfite | 2.78 g |
| Potassium iodide | 1.20 mg |
| Sodium bromide | 1.31 g |
| Diethylenetriaminepentacetic acid pentasodium salt (40% solution) | 8.43 g |
| Hydroxylamine sulfate | 2.41 g |
| Kodak Color Developing Agent CD-4 | 4.52 g |
| Water to make | 1 liter |
| pH @ 26° C. 10.0 ± 0.05 | |

Step 3

The coatings are then bleached for 4 minutes at a temperature of 39.0° C. in a solution comprising:

| | |
|---|---|
| Ammonium bromide | 50.00 g |
| 1,3 Propane diaminetetra-acetic acid | 30.27 g |
| Ammonium hydroxide (28%) | 35.20 g |
| Ferric nitrate monohydrate | 36.40 g |
| Glacial acetic acid | 26.50 g |
| 1,3 diamino-2-propanoltetra-acetic acid | 1.00 g |
| Ammonium ferric EDTA (1.56M, pH 7.05, 44% wt.) (contains 10% molar excess EDTA, 3.5% wt.) | 149.00 g |
| Water to make | 1 liter |
| pH to 5.25 ± 0.10 | |

Step 4

The coatings are then washed with water for 3 minutes at 35°–36° C.

Step 5

The coatings are then fixed for 4 minutes at 38.0° C. in a solution comprising:

| | |
|---|---|
| Ammonium thiosulfate (58% solution) | 214.00 g |
| (Ethylenedinitrilo)tetraacetic acid disodium salt, dihydrate | 1.29 g |
| Sodium metabisulfite | 11.00 g |
| Sodium hydroxide (50% solution) | 4.70 g |
| water to make | 1 liter |
| pH of 6.5 ± 0.15 | |

Step 6

The coatings are again washed in water for 3 minutes at 38° C.

Step 7 The coatings are finally immersed for 1 minute at 38.0° C. in a stabilizing bath comprising:

| | |
|---|---|
| Formaldehyde (37% solution, 12% methanol) | 3.60 g |
| Polyalkoxylate dimethylpolysiloxane | 0.83 g |
| water to make | 1 liter |

The coatings were allowed to dry then were subjected to status M densitometry. For Examples 1 through 3 a speed difference relative to element 7 was determined by simultaneously comparing the coatings from each of the 5 development times and determining an average speed difference. A speed difference was determined in the same way for Examples 4 through 6 by comparing them to element 8. The results are tabulated in Table I.

TABLE I

| Example | Layer 1 Emulsion Type | Layer 3 Silver Level g/m$^2$ | Relative* Layer 1 Speed Change Log Exposure |
|---|---|---|---|
| 7 | non-tabular | 0 | 0 (check for 1,2,3) |
| 1 | non-tabular | 0.54 | −0.06 |
| 2 | non-tabular | 1.08 | −0.10 |
| 3 | non-tabular | 2.15 | −0.25 |
| 8 | tabular | 0 | 0 (check for 4,5,6) |
| 4 | tabular | 0.54 | +0.07 |
| 5 | tabular | 1.08 | +0.01 |
| 6 | tabular | 2.15 | −0.19 |

Note:
Speed losses from Examples 1 through 3 are relative to Example 7 and speed losses for Examples 4 through 6 are relative to Example 8.

Comparing the speed changes from the elements where the emulsion in layer 1 was non-tabular to the elements where the emulsion in layer 1 was tabular, it can be seen that the speed changes incurred by the blue-sensitive emulsion in layer 1, which are caused by screening by the overlying green-sensitive emulsion in layer 3 are clearly more favorable when the blue-sensitive emulsion is a properly blue light-sensitized tabular emulsion.

Examples 9–50

The following are full multilayer coatings comprised of either a tabular or a non-tabular blue-sensitized emulsion coated nearest an anti-halation support followed by a gelatin interlayer a tabular red-sensitized emulsion an additional gelatin interlayer then a tabular green-sensitized emulsion followed by a gelatin overcoat. The bottom two layers were hardened while the final four layers were left unhardened to allow wash-off processing as was used to process Examples 1–8.

The following Examples 9–50 show a comparison of blue light exposure speed losses between a non-tabular blue-sensitive emulsion and a properly sensitized tabular blue-sensitive emulsion due to optical screening by an overlying green-sensitized emulsion layer.

Incorporated coupler, full color (red, green, and blue sensitive) photographic elements designated 9–16 were constructed by coating the following layers in the following order on a cellulose triacetate film support having an anti-halation layer on the opposite side. Two incorporated coupler monocolor elements designated 12 and 16 were also constructed by omitting the green and red-sensitized tabular emulsion to provide the ideal speed positions of the blue-sensitive emulsion where there is no screening by any overlying emulsion layer such as in a conventional record order film.

Example 9

Layer 1

Blue-Light-Sensitive Layer—comprising a polydisperse non-tabular bromoiodide emulsion approximately 1.5 um in mean diameter with a bulk iodide content of 6.7 mole percent, chemically and spectrally sensitized with sodium thiosulfate, potassium chloroaurate, sodium thiocyanate, and blue sinsitizing dye A covering approximately 80% of the available grain surface area by methods well known in the art, and coated at 0.86 g/m$^2$, yellow image forming coupler C at 1.0 g/m$^2$, gelatin at 1.90 g/m$^2$, and antifoggant 4-hydroxy-6-methyl-1,3333,3a,7-tetraazaindene at 0.05 g/m$^2$, and bis(vinyl-sulfonylmethyl)ether at 1.75% of total gelatin weight.

Layer 2

Interlayer—comprising gelatin at 2.15 g/m$^2$, and bis(vinyl-sulfonylmethyl)ether at 1.75% of total gelatin weight.

Layer 3

Red-light-sensitive layer—comprising a bromoiodide tabular emulsion approximately 2.0 um in diameter and 0.08 um thick with a bulk iodide content of 4%, chemically and spectrally-sensitized with sodium thiosulfate, potassium chloroaurate, sodium thiocyanate, and green spectral sensitizing dyes B and C using methods well known in the art, and coated at 0.54 g/m$^2$, cyan image dye forming coupler A at 0.27 g/m$^2$, gelatin at 1.08 g/m$^2$.

Layer 4

Interlayer—comprising gelatin at 2.15 g/m$^2$.

Layer 5

Green-light-sensitive layer—comprising a bromoiodide tabular emulsion approximately 2.0 um in diameter and 0.08 um thick with a bulk iodide content of 4%, chemically and spectrally sensitized with sodium thiocyanate, and red spectral sensitizing dyes D and E using methods well known in the art, and coated at 0.54 g/m$^2$, magenta image dye forming coupler B at 0.27 g/m$^2$, gelatin at 1.08 g/m$^2$.

Layer 6

Overcoat—comprising gelatin at 2.15 g/m$^2$.

Example 10

A six layer structure identical to Example 9 except that the tabular emulsions in layers 3 and 5 are coated at 1.08 g/m$^2$, the couplers in layers 3 and 5 are coated at 0.54 g/m$^2$, and the gelatin in layers 3 and 5 is increased to 1.61 g/m$^2$.

Example 11

A six layer structure identical to Example 9 except that the tabular emulsions in layers 3 and 5 are coated at 2.15 g/m$^2$, the couplers in layers 3 and 5 are coated at 1.08 g/m$^2$, and the gelatin in layers 3 and 5 is increased to 3.23 g/m$^2$.

Example 12

A six layer structure identical to Example 9 except that 0.10 g/m$^2$ of blue light filter dye A are coated in layer 5 with the green sensitized emulsion.

Example 13

A six layer structure identical to Example 11 except that 0.10 g/m$^2$ of blue light filter dye A are coated in layer 5 with the green sensitized emulsion.

Example 14

A six layer structure identical to Example 9 except that 0.20 g/m$^2$ of blue light filter dye A are coated in layer 5 with the green sensitized emulsion.

Example 15

A six layer structure identical to Example 11 except that 0.20 g/m$^2$ of blue light filter dye A are coated in layer 5 with the green sensitized emulsion.

Example 16

A six layer structure identical to Example 9 except that 0.10 g/m$^2$ of blue light filter dye A are coated in layer 6.

Example 17

A six layer structure identical to Example 11 except that 0.10 g/m$^2$ of blue light filter dye A are coated in layer 6.

Example 18

A six layer structure identical to Example 9 except that 0.20 g/m$^2$ of blue light filter dye A are coated in layer 6.

Example 19

A six layer structure identical to Example 11 except that 0.20 g/m$^2$ of blue light filter dye A are coated in layer 6.

Example 20

A six layer structure identical to Example 9 except that 0.03 g/m$^2$ of colloidal silver blue filter are coated in layer 6.

Example 21

A six layer structure identical to Example 11 except that 0.03 g/m$^2$ of colloidal silver blue filter are coated in layer 6.

Example 22

A six layer structure identical to Example 9 except that 0.06 g/m$^2$ of colloidal blue filter are coated in layer 6.

Example 23

A six layer structure identical to Example 11 except that 0.06 g/m$^2$ of colloidal blue filter are coated in layer 6.

Example 24

A six layer structure identical to Example 9 except that the tabular emulsions in layers 3 and 5 are removed, the couplers in layers 3 and 5 are coated at 0.54 g/m$^2$, and the gelatin in layers 3 and 5 is at 1.61 g/m$^2$.

Example 25

A six layer structure identical to Example 9 except that the non-tabular blue-sensitive emulsion in layer 1 is replaced by a 3% bulk iodide bromoiodide tabular emulsion of approximately 3.4 um in diameter and 0.12 um in thickness also spectrally sensitized with blue-sensitizing dye A covering approximately 90% of the available surface area.

Example 26

A six layer structure identical to Example 25 except that the tabular emulsions in layers 3 and 5 are coated at 1.08 g/m$^2$, the couplers in layers 3 and 5 are coated at 0.54 g/m$^2$, and the gelatin in layers 3 and 5 is increased to 1.61 g/m$^2$.

Example 27

A six layer structure identical to Example 25 except that the tabular emulsions in layers 3 and 5 are coated at 2.15 g/m$^2$, the couplers in layers 3 and 5 are coated at 1.08 g/m$^2$, and the gelatin in layers 3 and 5 is increased to 3.23 g/m$^2$.

Example 28

A six layer structure identical to Example 25 except that 0.10 g/m$^2$ of blue light filter dye F are coated in layer 5 with the green sensitized emulsion.

Example 29

A six layer structure identical to Example 27 except that 0.10 g/m$^2$ of blue light filter dye F are coated in layer 5 with the green sensitized emulsion.

Example 30

A six layer structure identical to Example 25 except that 0.20 g/m$^2$ of blue light filter dye F are coated in layer 5 with the green sensitized emulsion.

Example 31

A six layer structure identical to Example 27 except that 0.20 g/m$^2$ of blue light filter dye F are coated in layer 5 with the green sensitized emulsion.

Example 32

A six layer structure identical to Example 25 except that 0.10 g/m$^2$ of blue light filter dye F are coated in layer 6.

Example 33

A six layer structure identical to Example 27 except that 0.10 g/m$^2$ of blue light filter dye F are coated in layer 6.

Example 34

A six layer structure identical to Example 25 except that 0.20 g/m$^2$ of blue light filter dye F are coated in layer 6.

Example 35

A six layer structure identical to Example 27 except that 0.20 g/m$^2$ of blue light filter dye F are coated in layer 6.

Example 36

A six layer structure identical to Example 25 except that 0.03 g/m$^2$ of colloidal silver blue light filter are coated in layer 6.

Example 37

A six layer structure identical to Example 27 except that 0.03 g/m$^2$ of colloidal silver blue light filter are coated in layer 6.

Example 38

A six layer structure identical to Example 25 except that 0.06 g/m$^2$ of colloidal silver blue light filter are coated in layer 6.

Example 39

A six layer structure identical to Example 27 except that 0.06 g/m$^2$ of colloidal silver blue light filter are coated in layer 6.

Example 40

(control for Examples 25–39)

A six layer structure identical to Example 25 except that the tabular emulsions in layers 3 and 5 are removed, the couplers in layers 3 and 5 are coated at 0.54 g/m$^2$, and the gelatin in layers 3 and 5 is at 1.61 g/m$^2$.

A summary of results from experiments 9–40 is shown in Table I below.

TABLE I

| Example | Layer 1 Emulsion Type | Total Layer 3 and 5 Silver Level | Blue Light Filter g/m$^2$ | Relative Layer 1 Speed Change log Exposure |
|---|---|---|---|---|
| 24 | non-tabular | 0 | 0 | (control for 9–23) |
| 9 | non-tabular | 1.08 | 0 | −.10 |
| 10 | non-tabular | 2.16 | 0 | −.19 |
| 11 | non-tabular | 4.32 | 0 | −.43 |
| 12 | non-tabular | 1.08 | 9 | −.36 |
| 13 | non-tabular | 4.43 | 9 | −.60 |
| 14 | non-tabular | 1.08 | 18 | −.66 |
| 15 | non-tabular | 4.32 | 18 | −.90 |
| 16 | non-tabular | 1.08 | 3 | −.40 |
| 17 | non-tabular | 4.32 | 3 | −.78 |
| 18 | non-tabular | 1.08 | 6 | −.69 |
| 19 | non-tabular | 4.32 | 6 | −1.05 |
| 20 | non-tabular | 1.08 | 9 | −.44 |
| 21 | non-tabular | 4.32 | 9 | −.78 |
| 22 | non-tabular | 1.08 | 18 | −.79 |
| 23 | non-tabular | 4.32 | 18 | −1.17 |
| 40 | tabular | 0 | 0 | (control for 25–39) |
| 25 | tabular | 1.08 | 0 | 0.0 |
| 26 | tabular | 2.16 | 0 | −.10 |
| 27 | tabular | 4.32 | 0 | −.33 |
| 28 | tabular | 1.08 | 9 | −.22 |
| 29 | tabular | 4.43 | 9 | −.45 |
| 30 | tabular | 1.08 | 18 | −.48 |
| 31 | tabular | 4.32 | 18 | −.73 |
| 32 | tabular | 1.08 | 3 | −.35 |
| 33 | tabular | 4.32 | 3 | −.72 |
| 34 | tabular | 1.08 | 6 | −.53 |
| 35 | tabular | 4.32 | 6 | −.90 |
| 36 | tabular | 1.08 | 9 | −.34 |
| 37 | tabular | 4.32 | 9 | −.73 |
| 38 | tabular | 1.08 | 18 | −.72 |
| 39 | tabular | 4.32 | 18 | −1.09 |

NOTE: The blue light filter dye in Examples 12–15 and 28–31 was located in layer 5 with the magenta sensitized emulsion. The blue light filter in Examples 16–19 and 32–35 was colloidal silver rather than dye F. Examples 9–24 are Control Examples.

An overall comparison of the layer 1 speed losses, when a tabular emulsion is used in layer 1, to the speed loss for the identical overlying conditions where a non-tabular emulsion was used in layers 1 shows that the speed losses in the tabular layer 1 range from 0.05 to 0.18 log E less than what they are if a non-tabular emulsion is used in layer 1.

Comparison of the layer 1 speed losses from examples 16 through 40 shows that when a blue filter such as colloidal silver or a dye is used in the overcoat or within an overlying emulsion layer, the relative speed losses are less when a tabular blue light sensitized emulsion is used in layer 1.

Examples 41–50 are full multicolor coatings which compare the optical blue speed losses of underlying tabular and non-tabular blue sensitized emulsions in an inverted structure film where non-tabular emulsions have been used in the overlying red sensitive and green sensitive layers.

Example 41

A six layer structure identical to Example 9 except that the tabular emulsions in layers 3 and 5 are replaced by non-tabular emulsions with a diameter of 1.3 um and a bulk iodide of 4% coated at a level of 0.27 g/m$^2$, the couplers in layers 3 and 5 are coated at 0.13 g/m$^2$, and gelatin in layers 3 and 5 is 0.40 g/m$^2$.

Example 42

A six layer structure identical to Example 41 except that the non-tabular emulsions in layers 3 and 5 are coated at 0.54 g/m$^2$, the couplers in layers 3 and 5 are coated at 0.27 g/m$^2$, and gelatin in layers 3 and 5 is increased to 0.80 g/m$^2$.

Example 43

A six layer structure identical to Example 41 except that the non-tabular emulsions in layers 3 and 5 are coated at 1.08 g/m$^2$, the couplers in layers 3 and 5 are coated at 0.54 g/m$^2$, and gelatin in layers 3 and 5 is increased to 1.61 g/m$^2$.

Example 44

A six layer structure identical to Example 41 except that the non-tabular emulsions in layers 3 and 5 are coated at 2.15 g/m$^2$, the couplers in layers 3 and 5 are coated at 1.08 g/m$^2$, and gelatin in layers 3 and 5 is increased to 1.60 g/m$^2$.

Example 45

A six layer structure identical to Example 41 except that the non-tabular emulsions and couplers in layers 3 and 5 are removed, and the gelatin in layers 3 and 5 is increased to 1.08 g/m$^2$. This coating is used as a blue speed control for coatings 41 through 44.

Example 46

A six layer structure identical to Example 41 except that the non-tabular blue sensitive emulsion in layer 1 is replaced by a 3% bulk iodide bromoiodide tabular emulsion of approximately 3.4 um in diameter and 0.12 um in thickness also spectrally sensitized with blue sensitizing dye A covering approximately 90% of the available surface area.

Example 47

A six layer structure identical to Example 46 except that the non-tabular emulsions in layers 3 and 5 are coated at 0.54 g/m$^2$, the couplers in layers 3 and 5 are coated at 0.27 g/m$^2$, and gelatin in layers 3 and 5 is increased to 0.80 g/m$^2$.

Example 48

A six layer structure identical to Example 46 except that the non-tabular emulsions in layers 3 and 5 are coated at 1.08 g/m$^2$, the couplers in layers 3 and 5 are coated at 0.54 g/m$^2$, and gelatin in layers 3 and 5 is increased to 1.61 g/m$^2$.

Example 49

A six layer structure identical to Example 46 except that the non-tabular emulsions in layers 3 and 5 are coated at 2.15 g/m$^2$, the couplers in layers 3 and 5 are coated at 1.08 g/m$^2$, and gelatin in layers 3 and 5 is increased to 1.60 g/m$^2$.

Example 50

A six layer structure identical to Example 46 except that the non-tabular emulsions and couplers in layers 3 and 5 are removed, and the gelatin in layers 3 and 5 is increased to 1.08 g/m$^2$. This coating is used as a control for coatings 46 through 49.

Examples 9–50 were exposed, processed and the densities measured as described in Examples 1–8.

A summary of the results from experiments 41 through 50 is shown below in Table III.

TABLE III

| Example | Layer 1 Emulsion Type | Total Layer 3 and 5 Silver Level g/m$^2$ | Relative Layer 1 Speed Change log Exposure |
|---|---|---|---|
| 45* | non-tabular | 0 | (control for 41–44) |
| 41* | non-tabular | 0.54 | –.02 |
| 42* | non-tabular | 1.08 | –.03 |
| 43* | non-tabular | 2.16 | –.08 |
| 44* | non-tabular | 4.32 | –.23 |
| 50* | tabular | 0 | (control for 46–49) |
| 46 | tabular | 0.54 | 0.0 |
| 47 | tabular | 1.08 | –.01 |
| 48 | tabular | 2.16 | –.04 |
| 49 | tabular | 4.32 | –.17 |

*Control Examples

Comparing the relative layer 1 speed losses when a tabular blue-sensitized layer was used in layer 1 to the speed losses of the identical coatings where a non-tabular blue-sensitized layer 1 again shows that the speed losses incurred by the tabular blue-sensitive layer are surprisingly less than those seen for the non-tabular blue-sensitive layer.

Spectral sensitizing dyes used in the photographic elements described above and not earlier described have the following structures:

Red light sensitizing dye D

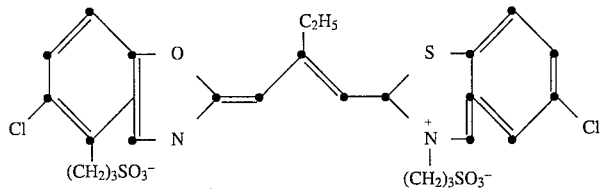

-continued

Red light sensitizing dye E

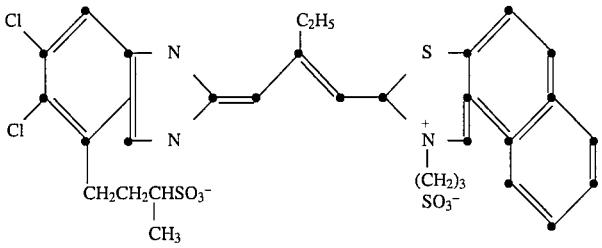

Blue light filter dye F

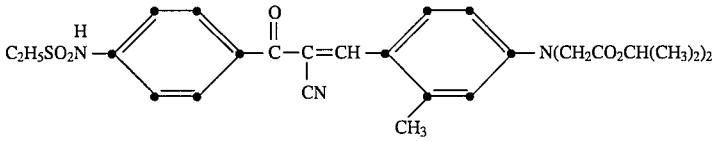

Image dye forming couplers used in the photographic elements described above but not disclosed in Docket 55.573 have the following structures:

Yellow dye forming coupler C

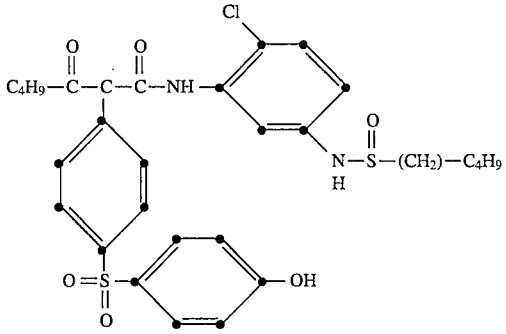

The invention has been describe in detail with particular reference to preferred embodiments thereof, but it will be understood that variations and modifications can be effected within the spirit and scope of the invention.

We claim:

1. A color photographic negative film wherein a blue sensitive layer is below a green sensitive layer and said blue sensitive layer comprises blue-sensitized tabular grains with an aspect ratio of at least 5 that are sensitized with a blue dye which absorbs light primarily in the region between 450 and 520 nanometers and wherein said film further comprises a yellow colored masking coupler that forms magenta dye when developed and absorbs blue light in the 400–450 nanometer range during exposure.

2. The film of claim 1 wherein said tabular grains have an aspect ratio of at least 8.

3. The film of claim 1 wherein said tabular grain has a surface to volume ratio of at least 10:1.

4. The film of claim 1 wherein said tabular grains have an aspect ratio of greater than 8 and make up greater than 90 per cent of the grains in said blue absorbing layer.

5. The film of claim 1 further comprising a red sensitive layer above said blue sensitive layer and below said green sensitive layer.

6. The film of claim 1 wherein the said green sensitive layer passes most light in the 450–520 nanometer range.

7. The film of claim 1 wherein said blue dye comprises

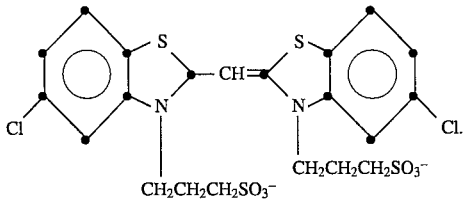

8. The film of claim 1 further comprising a red sensitive layer above said blue sensitized and above said green sensitive layer.

* * * * *